US006243543B1

(12) United States Patent
Nozawa

(10) Patent No.: US 6,243,543 B1
(45) Date of Patent: Jun. 5, 2001

(54) DEVELOPING DEVICE FOR DEVELOPING A LATENT IMAGE

(75) Inventor: Taizo Nozawa, Kanagawa-ken (JP)

(73) Assignees: Toshiba Tec Kabushiki Kaisha, Tokyo; Kabushiki Kaisha Toshiba, Kawasaki, both of (JP)

( * ) Notice: Subject to any disclaimer, the term of this patent is extended or adjusted under 35 U.S.C. 154(b) by 0 days.

(21) Appl. No.: 09/464,409

(22) Filed: Dec. 16, 1999

(30) Foreign Application Priority Data

Dec. 17, 1998 (JP) ..... 10-359096

(51) Int. Cl.[7] ..... G03G 15/08
(52) U.S. Cl. ..... 399/55
(58) Field of Search ..... 399/55, 56

(56) References Cited

U.S. PATENT DOCUMENTS 4,236,813 * 12/1980 Levine ..... 358/500
5,500,720 3/1996 Karasawa ..... 355/265

FOREIGN PATENT DOCUMENTS 7-5735 1/1995 (JP) .

* cited by examiner

*Primary Examiner*—Quana M. Grainger
(74) *Attorney, Agent, or Firm*—Foley & Lardner

(57) ABSTRACT

A developing device includes a charger configured to charge a surface of an image carrier uniformly during its movement, an exposure unit configured to expose an optical image to form an electrostatic latent image on the charged image carrier, a developing unit provided facing the image carrier to supply developing agent to the image carrier to develop the electrostatic latent image. The developing unit includes a first developing roller and a second developing roller arranged at the down stream side of the first developing roller in the moving direction of the image carrier. Further, the developing device includes a bias voltage transformer configured to apply a bias voltage to the first and second developing rollers, a controller configured to control the bias voltage transformer to apply a regular bias voltage of the same polarity as the charged image carrier to the first developing roller when the leading edge of the charged area on the image carrier passes the position facing the first developing roller after the charging to the image carrier has started, and a driver to configured to start to drive the developing unit before the leading edge of the electrostatic latent image formed on the image carrier passes the position facing the first developing roller after the controller controls the bias voltage transformer to apply the regular bias voltage.

15 Claims, 11 Drawing Sheets

WHEN DEVELOPING BIAS IS TURNED ON AT THE TIME WHEN DRUM CHARGED PORTION REACHES FIRST DEVELOPING ROLLER

WHEN DEVELOPING BIAS IS TURNED ON AT THE TIME WHEN DRUM CHARGED PORTION REACHES SECOND DEVELOPING ROLLER

WHEN SWITCHING BIAS VOLTAGE AT THE TIME WHEN NOT CHARGED PORTION ON DRUM REACHES FIRST DEVELOPING ROLLER

WHEN SWITCHING BIAS VOLTAGE AT THE TIME WHEN NOT CHARGED PORTION ON DRUM REACHES SECOND DEVELOPING ROLLER

TIMING IN AUTOMATIC TONER ADJUSTMENT OF TRANSFORMER WITHOUT REVERSE BIAS

DEVELOPING DEVICE FOR DEVELOPING A LATENT IMAGE

BACKGROUND OF THE INVENTION

1. Field of the Invention

The present invention relates to a developing device comprising plural developing rollers to supply toner to an image carrier for developing a latent image, and used in, for instance, copying machines.

2. Description of the Related Art

In the field of electro-photography, printing speed of printers and copying machines have become extremely fast recently.

However, with the increase in the printing speed of an electro-photographic printer, the rotary speed of a photosensitive drum serving as an image carrier, that is, a process speed becomes fast accordingly. Because amount of development per unit time of a developing device (amount of toner to be adhered to the photosensitive drum) becomes less, the printing capacity drops basically. In other words, the density of image to be printed on a paper drops.

In addition, from the viewpoint of the photosensitive drum, when the rotary speed of a photosensitive drum becomes fast, it is inevitable to increase the diameter of the photosensitive drum for sensitivity, etc. When the diameter of the photosensitive drum becomes large, image quality tends to be deteriorated. When the print speed becomes fast, various problems including drop of image density, deterioration of image quality, etc. will result and it becomes necessary to solve these problems. As a means for solving these problems, there is a so-called plural roller developing device equipped with plural developing rollers (developer carriers) in small diameter in one developing device.

In the case of such a plural developing roller type developing device, it is possible to extract superior performance of any of image density, fogging characteristic, document reproducibility and life characteristic exceptionally higher than a single developing roller type developing device. However, there are also some problem points.

What is most important among the problems is that developing bias voltage is supplied to plural magnetic rollers serving as plural developing rollers from the same transformer and that an all over developing or a carrier-adhering on a white background generating at the time of starting and stopping the developing device caused therefrom.

These phenomena will be described below.

FIG. 1 is a diagram showing the relationship between a development contrast/a white background contrast versus all over developing/a carrier-adhering on a white background (in the case of reversal development). The development contrast referred to here is a difference between developing bias voltage (hereinafter called VB) and residual potential (hereinafter called Ver) and concerned in an image density and an image is developed according to this potential difference. On the other hand, the white background contrast is a difference between VB and surface potential (hereinafter called VO) of a photosensitive drum and is concerned in the carrier-adhering on a white background and fogging.

As shown in FIG. 1, the magnitude of the development contrast is equal to that of the image density. That is, the more the development contrast becomes large, the more thick development, that is, a so-called all over developing is made. On the other hand, regarding the contrast on a white background, when it is large, the carrier-adhering increases and when it is small, the fogging level becomes worse. Such phenomena are generated from the fact that VO, VB, Ver and toner are all the same polarity and carrier particle only is reverse polarity.

Next, the all over developing phenomenon or the carrier-adhering on a white background that is generated from the supply of developing bias voltage to plural magnetic rollers from the same transformer when starting and stopping a developing device will be described.

First, the operation at the time of the normal starting will be described referring to a timing chart shown in FIG. 2. First, the photosensitive drum drive motor that rotates the photosensitive drum is turned on and reverse bias voltage is output. The reason for outputting reversal developing bias voltage here is that a potential difference between the photosensitive drum and a sleeve of the developing roller must had been generated when the not charged area on the photosensitive drum passes the front surface of the developing rollers. Because, the fogging phenomenon comes out on the photosensitive drum since the developing rollers are rotating.

In other words, if the potential on the photosensitive drum was zero and the potential on the developing rollers was zero, the white background contract will become zero and the considerably remarkable fogging phenomenon would be produced. In this case, reverse bias voltage is voltage of reverse polarity to potential on the photosensitive drum and regular bias voltage is voltage of the same polarity to potential of the photosensitive drum. This reverse bias voltage is generally used for the reversal development.

Then, the developer drive motor is turned on in succession to operate the developing device. Thereafter, charging voltage is output to the photosensitive drum and lastly, regular developing bias voltage is output. In the case of a single roller developing device, there is no problem at this timing. However, in the case of a plural roller developing device, various problems will be generated depending on the output timing of regular developing bias voltage.

Kinds of defective phenomena differ depending on the turn-on timing of developing bias voltage when the charged area on the photosensitive drum has reached the developing roller at the upper stream side in the developing device and when the charged area has reached the developing roller at the downstream as shown in FIGS. 3A and 3B. Whenever developing bias voltage is supplied from the same transformer, the above-mentioned problem will be generated when a plural roller developing device is started. That is, there is no proper timing for applying developing bias voltage that is adequate for generating no defects. Needless to say, it is possible to solve the above-mentioned problems if a developing bias voltage transformer was provided for each developing roller; however, cost will increase by two times and the actual adoption is not realistic.

Next, the timing at the of normal stopping will be described referring to FIG. 4. That is, after detecting the trigger of completing the print, the charging voltage output is first turned off and in succession, regular developing bias voltage is switched to reversal developing bias voltage. The reason for why developing bias voltage is switched to reverse bias voltage instead of turning-off at this time is the same as that at the time of starting. That is, because the developing rollers are rotating, if a difference between potential of the photosensitive drum and bias voltage of the developing rollers is zero, the fogging phenomenon is presented on the photosensitive drum. So, when developing bias voltage is made to reverse polarity, the fogging phenomenon is not generated. Use of reverse bias voltage here is a practice of common sense.

In succession, the developing device is stopped (the developer drive motor is turned off), the photosensitive drum is then stopped (the drum drive motor is turned off) and lastly, reversal developing bias voltage is turned off. In the case of a single roller developing device, no problem will be generated at this timing; however, in the case of a plural roller developing device, defects can be generated depending on the timing for switching regular developing bias voltage to reversal developing bias voltage.

That is, a kind of defective phenomenon differs between the timing for switching the regular developing bias voltage to reversal developing bias voltage when the not-charged area on the photosensitive drum reached the developing roller at the upper stream and that when it reached the developing roller at the downstream.

As shown in FIGS. 5A and 5B, when the developing bias voltage is supplied from the same transformer, the all over developing or the carrier-adhering on a white background will be generated whenever stopping a developer equipped with plural rollers. That is, there is no adequate timing for turning off the developing bias voltage so that no defect is produced.

Thus, the above-mentioned problems will be generated on prior art developing devices equipped with plural developing rollers when starting and stopping. Further, if the above-mentioned problems are generated, problems shown below will result.

First, as regards the all over development, as all over developing is made excessively at every printing, such problems as increased toner consumption, decreased amount of recovered toner, increased toner scattering, short-life of cleaning mechanism (blade, fur brush, etc.) of the photosensitive drum itself and peripheral equipment (a transferring belt, etc.) in contact with the photosensitive drum will result.

On the other hand, as regards the carrier-adherence on a white background, it is also produced at every printing, such problems as damage of the photosensitive drum, short-life of the cleaning mechanism of the photosensitive drum itself and peripheral equipment connected to the photosensitive drum, drop of developing efficiency of the developer and loss of the developing function (generation of all over blurring, blade traces) due to decreased amount of toner, abnormal output value of an automatic toner sensor related to the input of toner, etc. will result. Thus, even when either one of the all over developing and the carrier-adhering on a white background is generated, the life of the developing device and copying machine equipped with this developing device will be shortened.

So far, apparatuses using a reversal developing device for the above-mentioned problems that are generated in the reversal development are a printer, facsimile machine, low price digital data using copying machine, etc. and are set for a short life. It is therefore the actual circumstances that even where there are the above-mentioned problems, no countermeasures were especially taken and products were manufactured without solving the problems.

However, high speed and long life digital data using copying machines have been promoted in recent years and it has been necessitated to solve the above-mentioned problems.

So, one plan for solving the above-mentioned problems when a high-speed digital data using copying machine using a developer equipped with plural developing rollers was opened to the public (Japanese Laid-open Publication No. 5735/1995). However, this plan relieves the above-mentioned problems and has no effect to prevent them completely.

That is, in the case of the image forming apparatus disclosed in Japanese Laid-open Publication No. 5735/1995, the photosensitive drum is started, the main charger is turned on and the developing bias voltage is switched to regular bias voltage −600V when the leading edge of the charged area o the photosensitive drum passes the position facing the second developing roller in the state with the reverse developing bias voltage +50V applied to the first and second developing rollers. Then, before the leading edge of an image portion on the photosensitive drum reaches the position facing the first developing roller, the operation of the developing device is started.

However, in the case of the image forming apparatus disclosed in Japanese Laid-open Publication No. 5735/1995, until the application of regular developing bias voltage starts, the charged area on the photosensitive drum passes the position facing the first developing roller with no regular development voltage applied, carrier particles on the first developing roller tends to move to the photosensitive drum side by the electric field produced by the charging potential on the photosensitive drum and such a problem that carrier particles to the photosensitive drum tends to be generated.

SUMMARY OF THE INVENTION

An object of the present invention is to provide a developing device capable of completely eliminate the all over developing and carrier-adhering on a white background that are generated when driving and stopping a developing device when a developing device-equipped with plural developing rollers is used.

According to the present invention, a developing device comprising charging means for uniformly charging a surface of an image carrier during its movement; exposure means for exposing to form an electrostatic latent image on the charged image carrier; developing means provided facing the image carrier for supplying developing agent to the image carrier to develop the electrostatic latent image, the developing means including a first developing roller and a second developing roller arranged at the down stream side of the first developing roller in the moving direction of the image carrier; bias applying means for applying a bias voltage to the first and second developing rollers; control means for controlling the bias applying means to apply a regular bias voltage of the same polarity as the charged image carrier to the first developing roller when the leading edge of the charged area on the image carrier passes the position facing the first developing roller after the charging to the image carrier has started; and driving means for starting to drive the developing means before the leading edge of the electrostatic latent image formed on the image carrier passes the position facing the first developing roller after the control means controls the bias applying means to apply the regular bias voltage, is provided.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
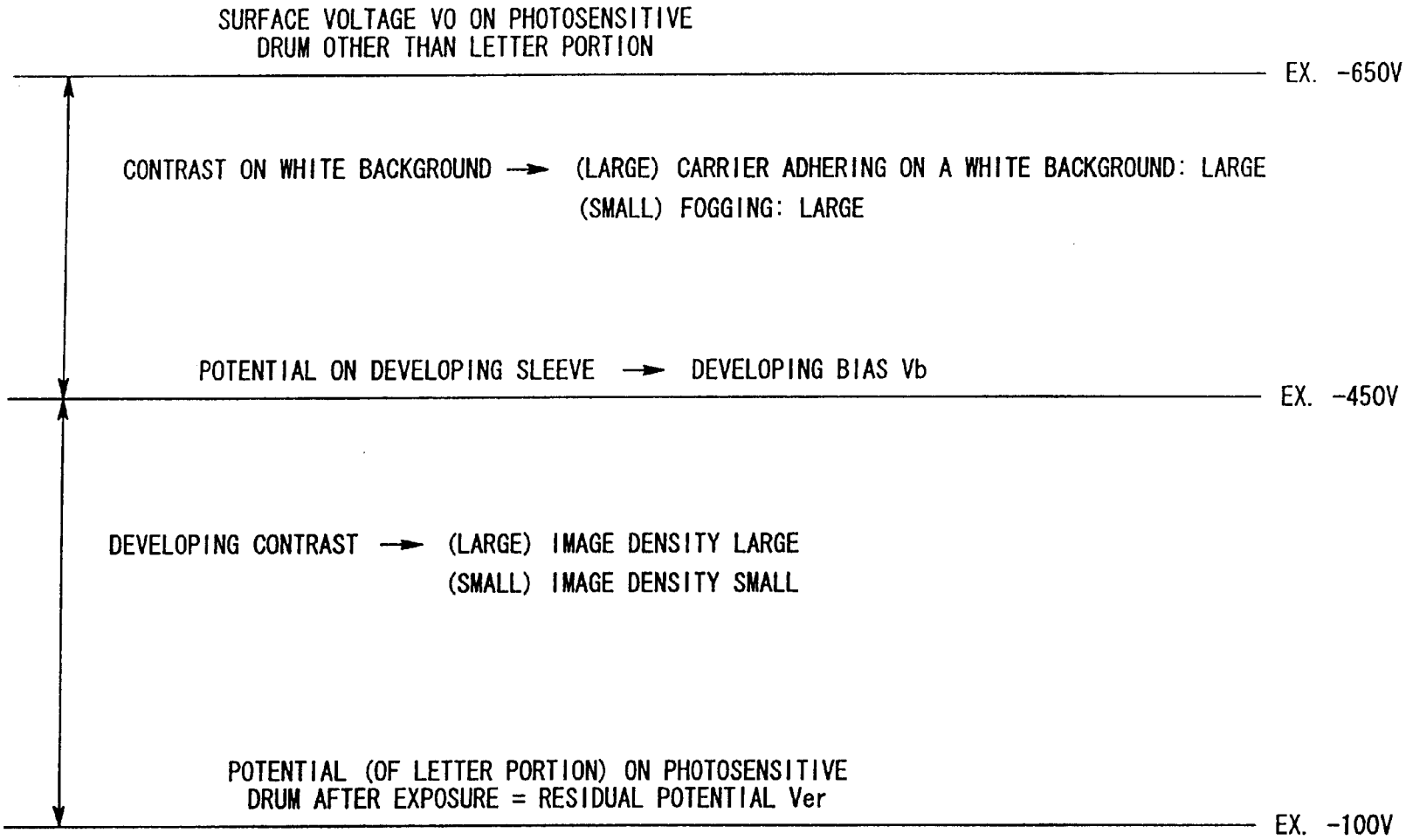
FIG. 1 PRIOR ART
FIG. 1 is a schematic view for explaining the relationship between a contrast on a white background/development contrast and an all over developing/white background carrier adhering of a prior art developing device.
Figure 2:
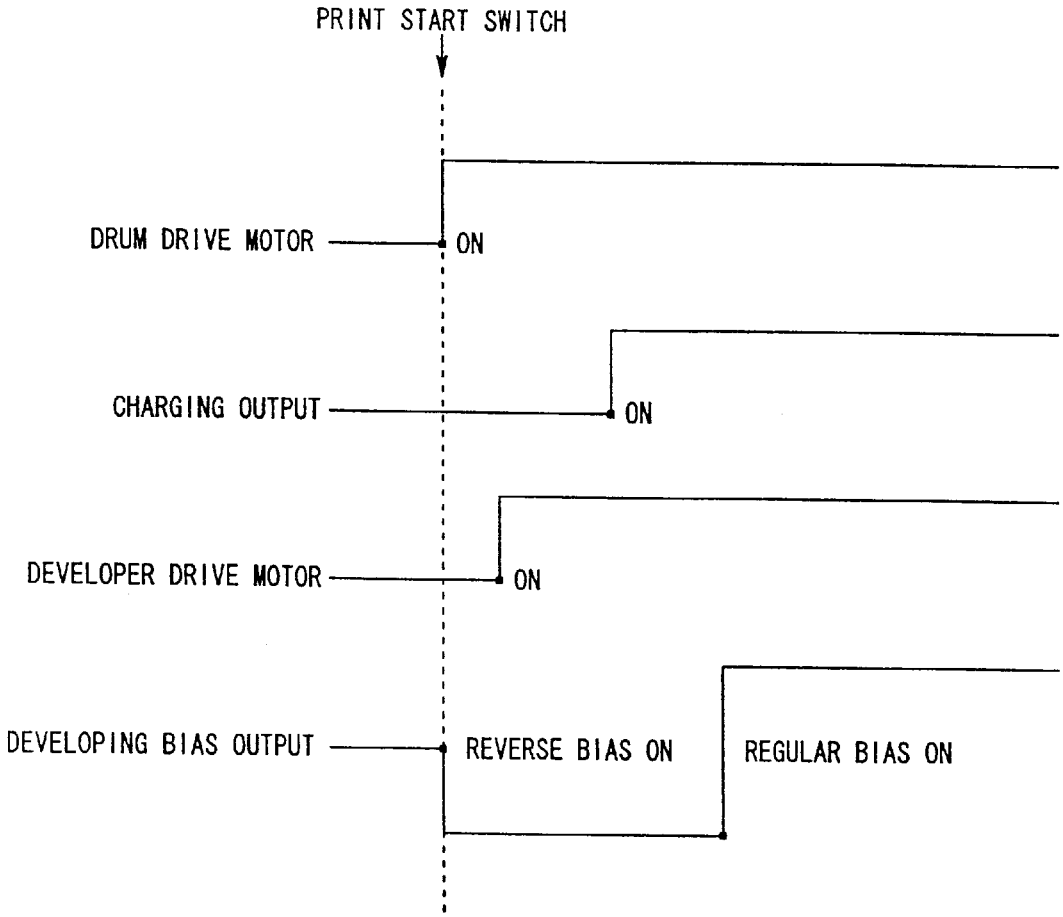
FIG. 2 PRIOR ART
FIG. 2 is a timing chart for explaining the operation timing at the start of a prior art developing device.

Referring to the drawings, the preferred embodiments the present invention will be described below.

FIG. 1 is a schematic view showing one example of a developing device of the present invention.

This developing unit is used in, for instance, a copying machine as an image forming apparatus. Such a copying machine reads an document image by a reading means, charges an image carrier by a charging means to a predetermined potential, exposes this charged image carrier by an exposure means according to the contents read by the reading means and thus, forms an electrostatic latent image. This electrostatic latent image on the image carrier is developed to a toner image and this developed toner image is transferred onto a transfer paper.

The developing device comprises a first developing roller (a developer carrier) 1, a second developing roller (a developer carrier) 2, a conveying roller 3, a doctor blade 4, a feed/recovery paddle 5, a first mixer 6*a*, a second mixer 6*b*, a main charger (a charging means) 7 and an automatic toner sensor 8.

The developing device houses a two-component developing agent comprising toner and carrier particles. Each of the first developing roller 1, second developing roller 2 and conveying roller 3 is composed of an aluminum made rotary sleeve and a magnet fixed in this rotary sleeve. The magnet has an N-pole and S-pole alternately arrange on its circumferential surface. Developing agent is adsorbed on the rotary sleeve by the magnetic force of the magnet and forms a magnetic brush.

The first developing roller 1 and the second developing roller 2 are so arranged as to maintain a fixed gap with the surface of a photosensitive drum 9 as an image carrier whereon an electrostatic latent image is formed.

The conveying roller 3 conveys a developing agent to the first developing roller 1 after regulating the developing agent received from the feed/recovery paddle 5 to a developing agent layer in a fixed thickness by the doctor blade 4. Thus, the doctor blade 4 is provided to control an amount of the developing agent adhered onto the sleeve of the conveying roller 3.

The feed/recovery paddle 5 feeds a toner to the conveying roller 3 and recovers the developing agent completed the developing process to the first and second mixers 6*a* and 6*b*.

The first and second mixers 6*a* and 6*b* stir carrier particles and toner and frictionally charge the carrier particles and toner to positive and negative polarity, respectively.

The main charger 7 is to charge the surface of the photosensitive drum 9 to a predetermined potential, and with the rotation of the photosensitive drum 9, charges the surface of the photosensitive drum 9 in order. Further, the main charger 7 is provided with a wire cleaning mechanism (not shown) and whether the wire cleaning mechanism operates properly is judged by a main controller 10.

The automatic toner sensor 8 detects a toner content ratio in the developing agent in the developing device.

The surface of the photosensitive drum 9 is charged to a predetermined potential by the main charger 7 and an image is exposed by an exposure scanner (an exposure means) and an electrostatic latent image is formed.

The controller 10 is composed of a main controller 11, a RAM 12, a ROM 13, a driver 15 to drive a drum drive motor 14, a driver 17 to drive a developer drive motor 16, charging voltage output 18, and a bias controller (a developing bias control means) 19.

The main controller 11 controls the entire developing device. The RAM 12 stores control data and others temporarily. The ROM 13 stores a control program and others.

The drum drive motor 14 drives the photosensitive drum 9. The developer drive motor 16 drives the first and second developing rollers 1 and 2 and at the same time, drives the conveying roller 3, the feed/recovery paddle 5, the first and second mixers 6*a* and 6*b*. The charging voltage output 18 applies predetermined voltage to the main charger 7 to charges the surface of the photosensitive drum 9 to a predetermined potential.

Figure 3A:
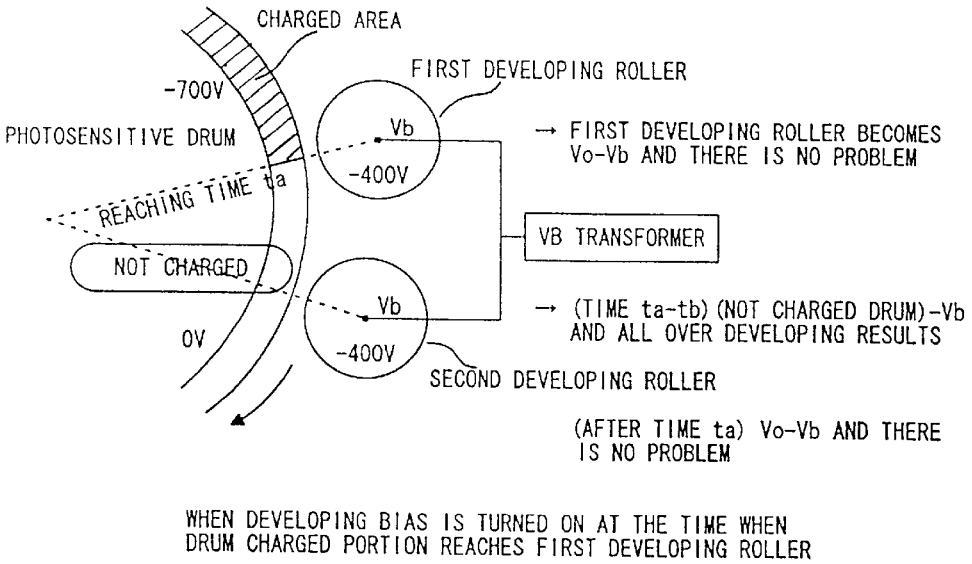
FIG. 3A PRIOR ART
FIGS. 3A and 3B are schematic views for explaining an all over developing/carrier-adhering at the time of start of a prior art developing device.
Figure 3B:
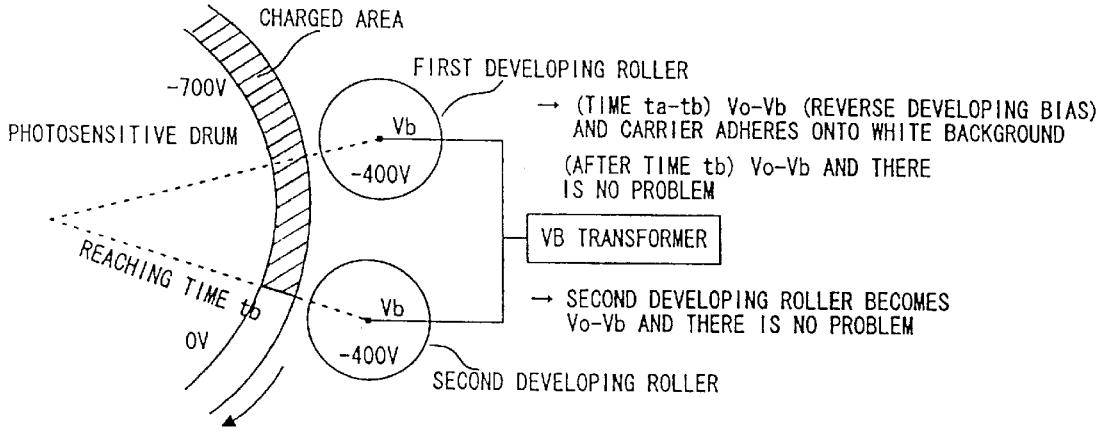
FIG. 3B PRIOR ART
Figure 4:
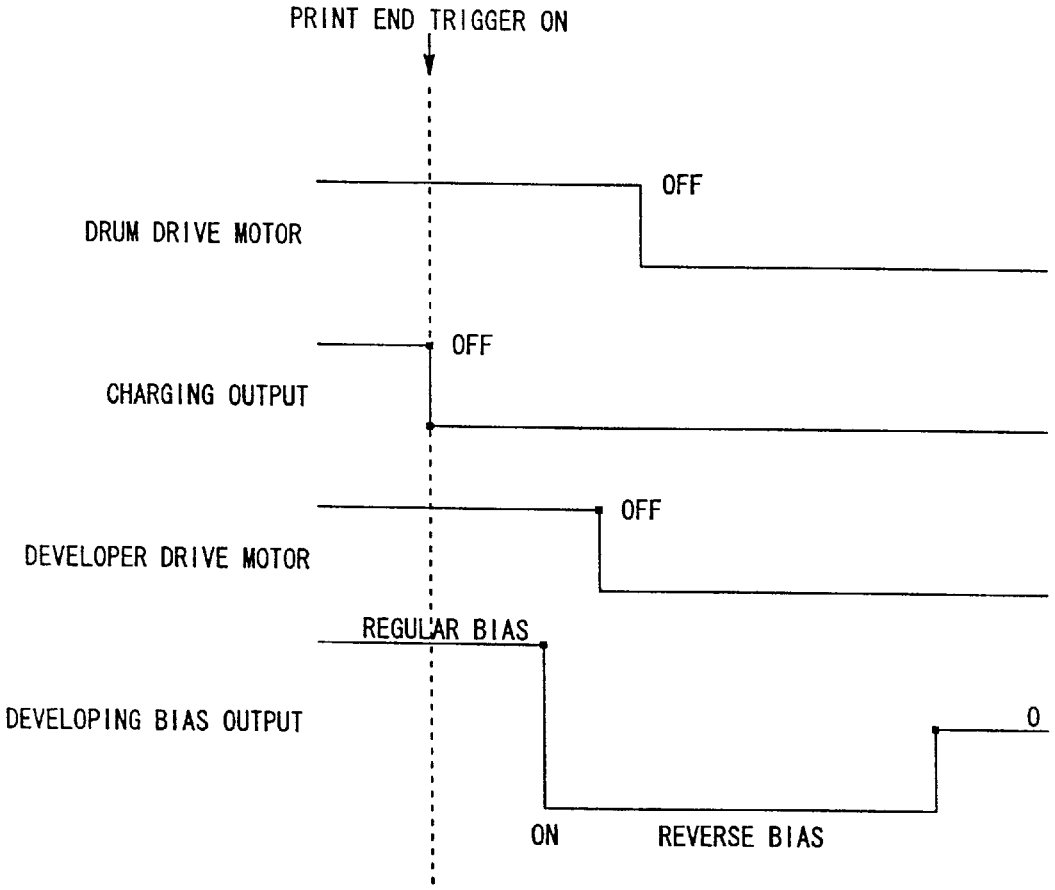
FIG. 4 PRIOR ART
FIG. 4 is a timing chart for explaining the operation timing at the stop of a prior art developing device.
Figure 5A:
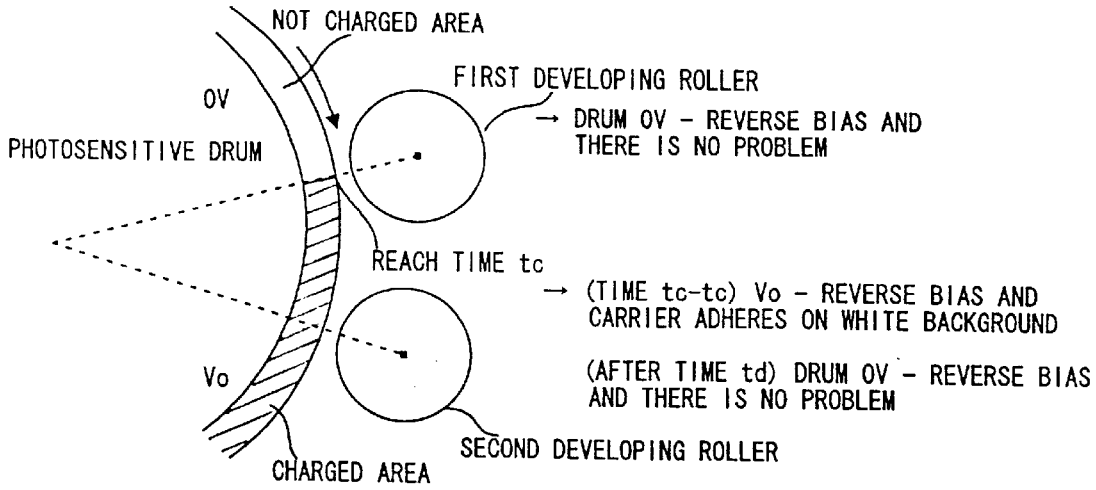
FIG. 5A PRIOR ART
FIGS. 5A and 5B are schematic views for explaining an all over developing/carrier-adhering at the time of stop of a prior art developing device.
Figure 5B:
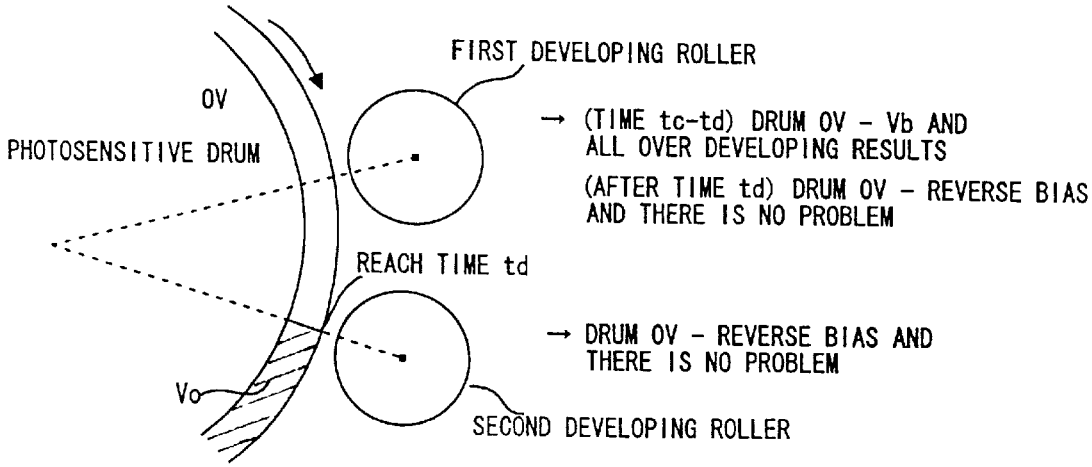
FIG. 5B PRIOR ART
Figure 6:
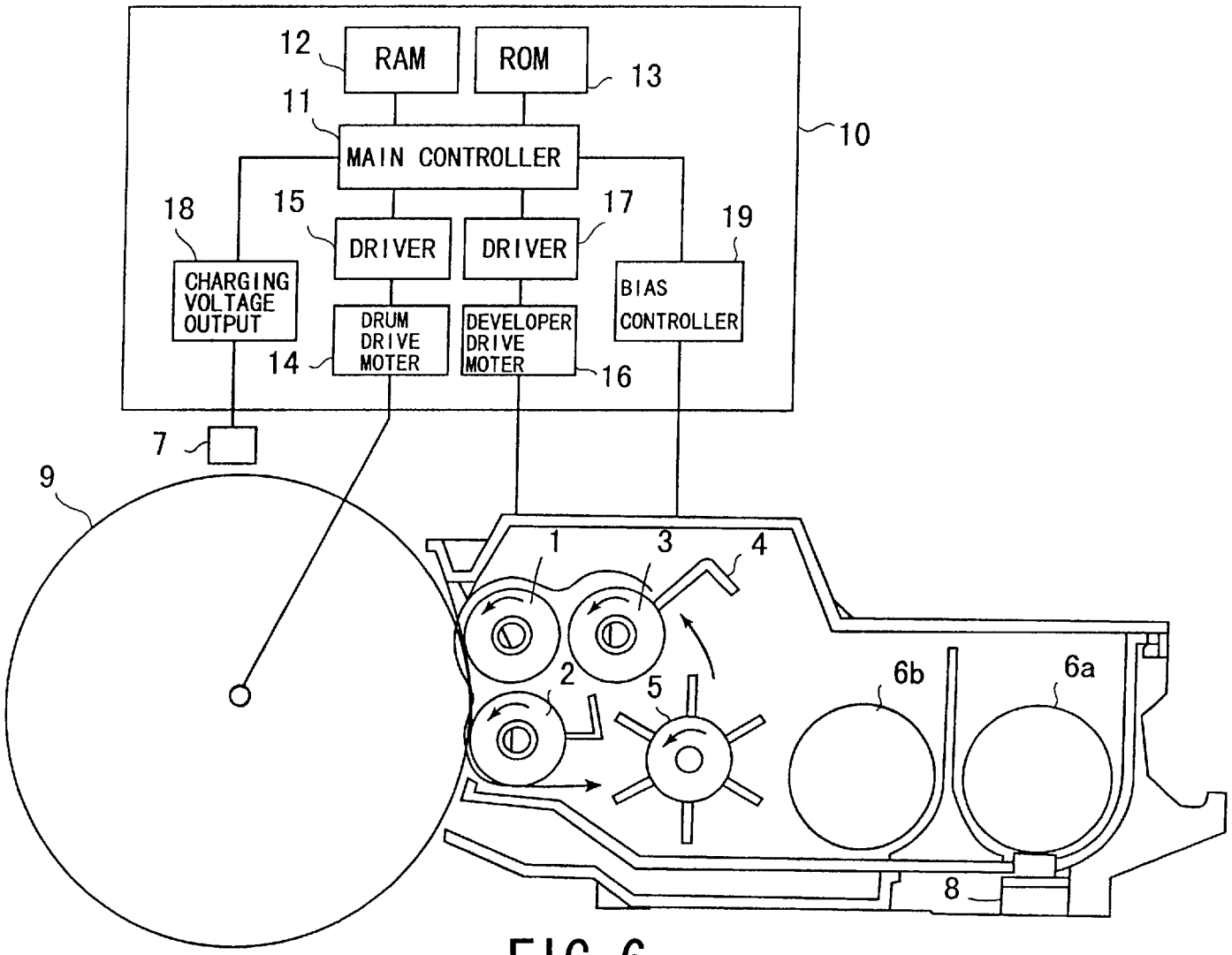
FIG. 6 is an view showing a schematic block diagram showing a developing device and its control blocks in an embodiment of the present invention.

The bias controller 19, equipped with a developing bias voltage transformer, controls the ON-OFF of normal developing bias voltage to be applied to the first and second developing rollers 1 and 2 at the time of development. That is, the developing bias voltage is supplied from the same transformer to the first and second developing rollers 1 and 2 at same time, as shown in FIGS. 3A and 3B. Further, when the bias controller 19 is so constructed as to apply predetermined reverse bias voltage at a timing described later, it is provided with a reverse bias voltage transformer and controls the ON-OFF of the reverse bias voltage.

Next, the start-up operation when starting the print using the developing device in the structure described above will be described referring to the timing chart shown in FIG. 7. Here, the control operation when a reverse bias voltage transformer is installed in the bias controller 19 will be described.

First, when starting the development, the main controller 11 starts to drive the drum drive motor 14 that rotates the photosensitive drum 9 and at the same time, feeds reverse bias voltage to the first and second developing rollers 1 and 2 by the reverse bias voltage transformer of the bias controller 19.

Then, the main controller 11 outputs charging voltage to the main charger 7 in order to charge the surface of the photosensitive drum 9 to a predetermined potential by the charging voltage output 18. On the lapse of a predetermined period of time (t1) from the turning-on of the charging voltage output until the charged area on the photosensitive drum 9 reaches the position facing the first developing roller 1, the main controller 11 switches reverse bias voltage to regular bias voltage by the developing bias voltage transformer of the bias controller 19 so that reverse bias voltage being applied to the first and second developing rollers 1 and 2 rises completely.

Further, on the lapse of a fixed period (t2) from the time when switched to the regular bias voltage, the main controller 11 turns on the developer drive motor 16 by the driver 17. At this time, the main controller 11 controls the operation so that the operating speeds in the developing device becomes completely to the steady state when the leading edge portion of an electrostatic latent image formed on the photosensitive drum 9 passes the position facing the first developing roller 1.

When the developing device starts to operate as described above, the operations in the developing device should start only after the charged potential on the photosensitive drum 9 and the potential of the first and second developing rollers 1 and 2 become the steady state (that is, the potential on the photosensitive drum becomes VO and the potential of the first and second developing rollers become VB).

As the result, the carrier-adherence on a white background and the all over developing when starting the operation can be completely eliminated.

Figure 8:
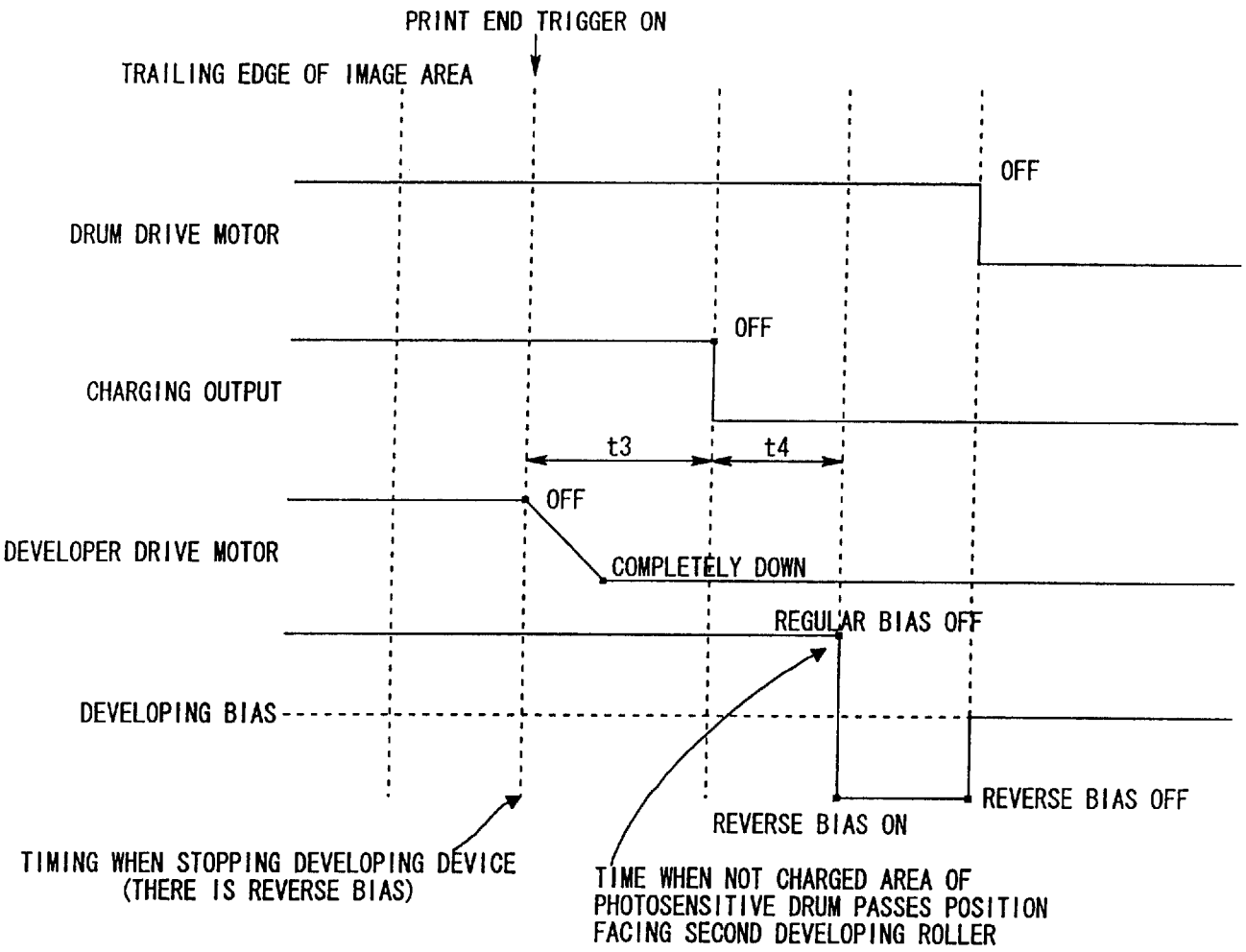
FIG. 8 is a timing chart for explaining the operation timing at the time of stop of the developing device of the present invention.

Next, the stopping operation of the developing device when the print ends will be described. FIG. 8 is a timing chart for explaining the operation timing when stopping the developing device.

First, when ending the developing operation, the main controller 11 stops the rotation of the developer drive motor 16 by the driver 17 in order to stop the rotation of the first and second developing rollers 1 and 2. At this time, the first and second developing rollers 1 and 2 are so controlled that they stop to rotate in the shortest period of time. Then, on the lapse of a predetermined period of time (t3) from the stop of the developer drive motor 16 till its complete stop, the main controller 11 turns off the charging voltage output.

Further, on the lapse of a period of time (t4) from the turn-off of the charging voltage output till the not-charged area on the photosensitive drum 9 passes the position facing the second developing roller 2, the main controller 11 turns off the regular developing bias voltage being applied to the first and second developing rollers 1 and 2 and turns on reverse bias voltage by the bias controller 19 so that reverse bias voltage has rose completely. Thereafter, the drum drive motor 14 is turned off by the driver 15 in order to stop the rotation of the photosensitive drum 9 and at the same time, the reverse bias voltage being applied to the first and second developing rollers 1 and 2 is turned off and the operation of the developing device is completely stopped.

As described above, when the developing device stops to operate, after the developer drive motor is first turned off, charging output on the photosensitive drum 9 is turned off, regular bias voltage is switched to reverse bias voltage and then, the photosensitive drum drive motor is turned off and reverse bias voltage is turned off.

Thus, the carrier-adherence on the white background and the all over developing at the time when stopping the operation of the developing device can be completely eliminated.

In the above-mentioned embodiment, the operation that is most differing from that of a prior art developing device is potential between the photosensitive drum 9 and the first and the second developing roller 1 and 2 before the developing device starts the developing operation. That is, in a prior art developing device, regular bias voltage to the first and second developing roller 1 and 2 is turned on after the charged area on the photosensitive drum 9 reached the second developing roller 2. On the other hand, in this invention, regular developing bias voltage is turned on when the charged area on the photosensitive drum 9 reached the first developing roller 1. In this case, from the viewpoint of potential, the prior art developing device operates at the timing generating the carrier-adhering on a white background while the present invention operates at the timing generating the all over developing.

Figure 9:
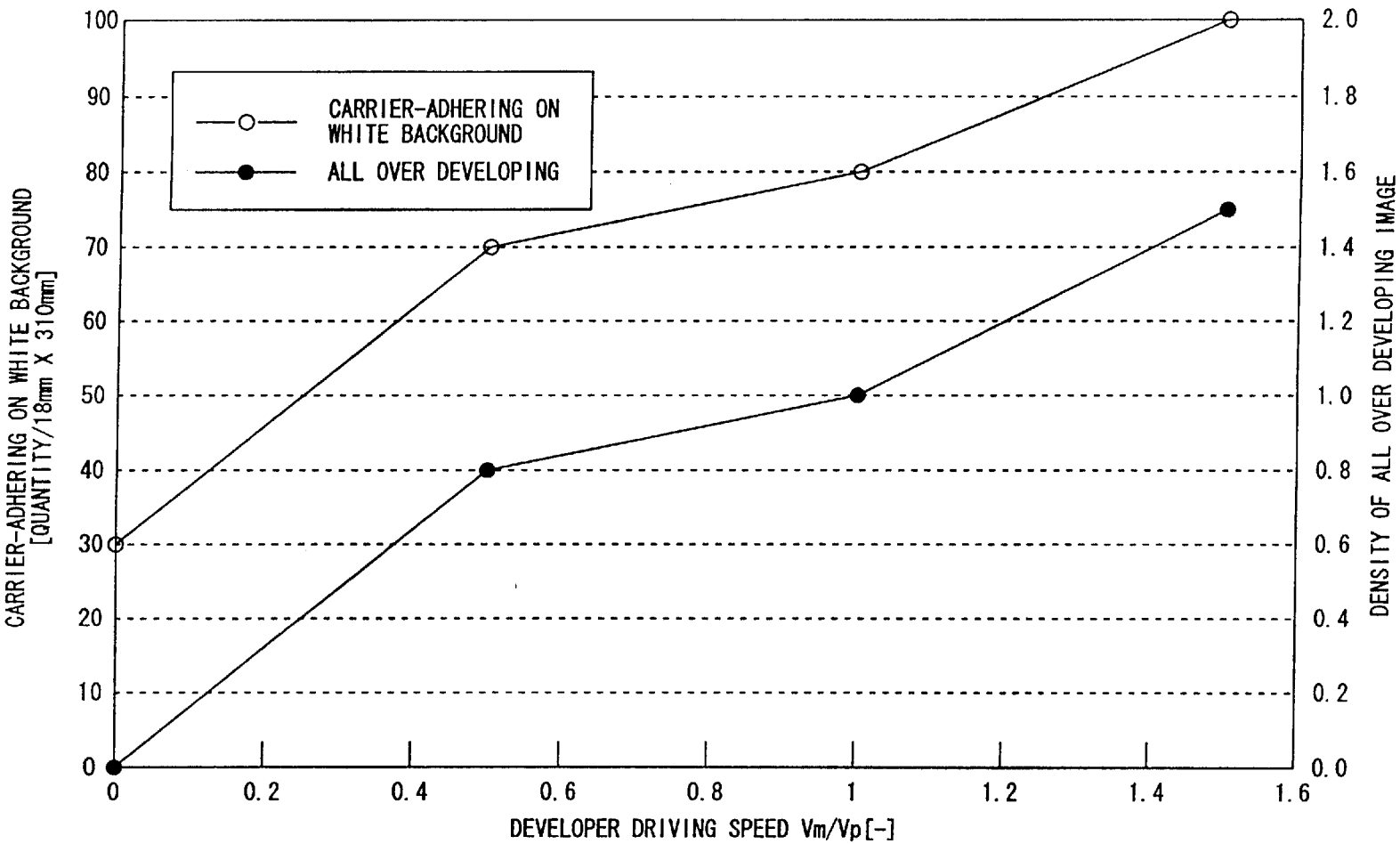
FIG. 9 is a graph showing the test results of degrees of occurrence of an all over developing and carrier-adhering on a white background versus the rotary speed of upper and lower magnet rollers of the developing device.

FIG. 9 is a graph showing the test result of degree of generating the carrier-adhering on a white background and the all over developing versus the operating speed of the developing device that is operated by the developer drive motor 16 including the first and second developing rollers 1 and 2. Further, plural roller developing devices were used as evaluating developing devices and two-component developing agent as an evaluating developing agent in the test. The effect checking tests were conducted in 3 kinds of environments; low temperature/low humidity, normal temperature/normal humidity and high temperature/high humidity using early stage products and nearly life exhausting products for photosensitive drums and developing agent (toner).

According to the test results as shown in FIG. 9, it is indicated that the generation of the carrier-adherence on a white background cannot be suppressed to zero even when the developing device is not in operation but the generation of the all over developing can be suppressed to zero unless the developing device is in operation.

In other words, in the state where the developing device is stopped, the carrier-adherence on a white background is somewhat relieved in the prior art. On the contrary, the all over developing can be completely eliminated when the developing device is stopped to operate as in this embodiment.

Figure 7:
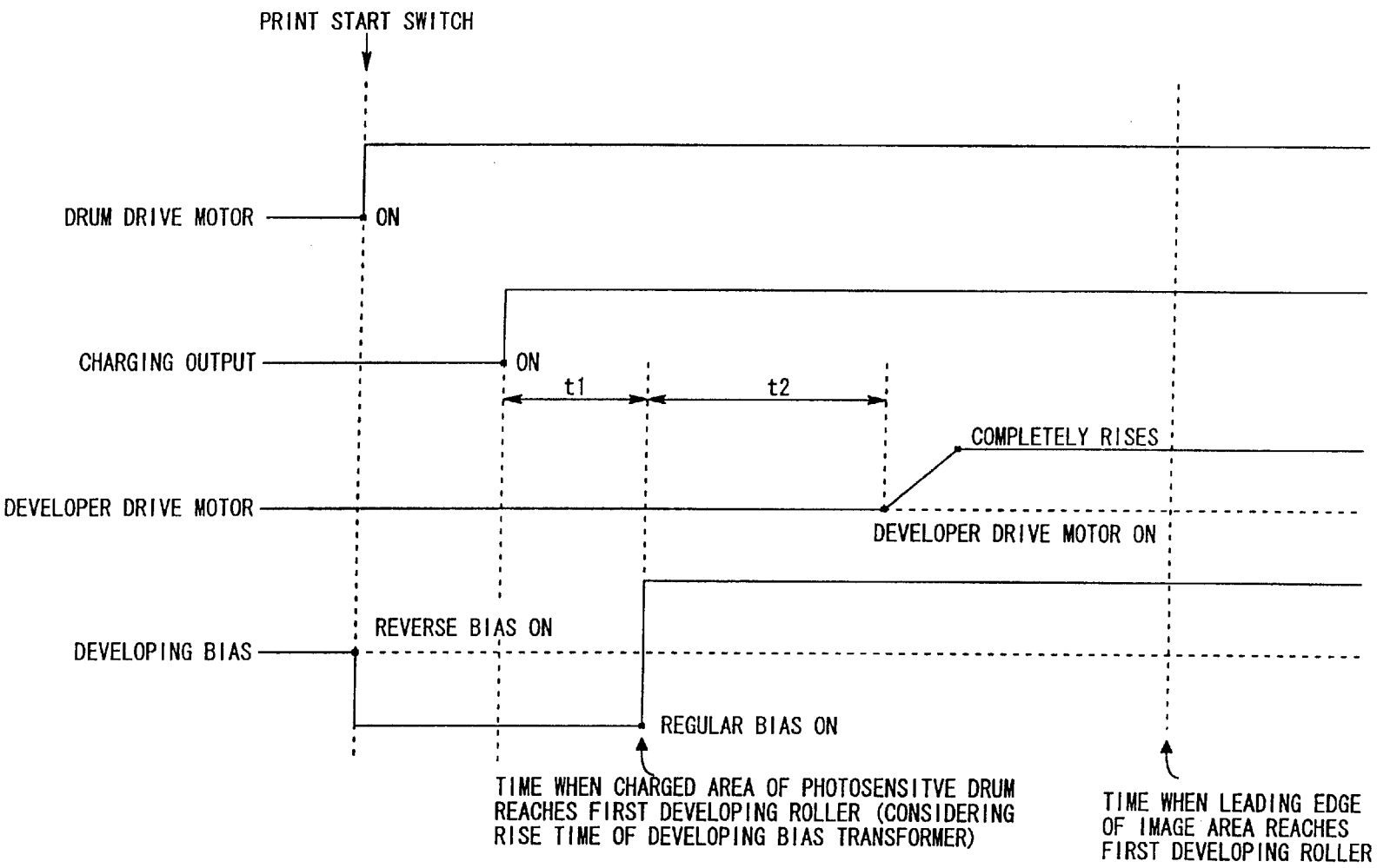
FIG. 7 is a timing chart for explaining the operation timing at the start of the developing device of the present invention.

Further, the operation in the normal printing is described in the above embodiment, the operation at the timing as shown in FIGS. 7 and 8 may be applicable to such adjustments, for instance, at the time of the warm-up of a copying machine, the toner empty canceling in the developing device, the automatic toner adjustment, etc. For instance, as regards the automatic toner adjustment, a reverse bias voltage transformer is provided to the bias controller 19, the photosensitive drum is not charged likewise a general reversal developing devise, reverse bias voltage is applied to the first and the second developing rollers 1 and 2 and the operation is executed similarly in the normal printing at the operation timing shown in FIG. 7 or FIG. 8.

Thus, it is possible to execute the operation without causing all over developing and carrier-adherence on a white background in warming up of a digital data using copying machine, toner empty canceling and automatic toner adjustment in a developing device.

Next, in the above embodiment a case using the bias controller 19 equipped with a reverse bias voltage transformer was described. Now, a case using the bias controller 19 equipped with a normal developing bias voltage transformer only without using a reverse bias voltage transformer will be described.

In this case, using the bias controller 19 without equipping an expensive reverse bias voltage transformer but equipped with a cheap ordinary developing bias voltage transformer, the driving and stopping operations of the developing device are executed.

Figure 10:
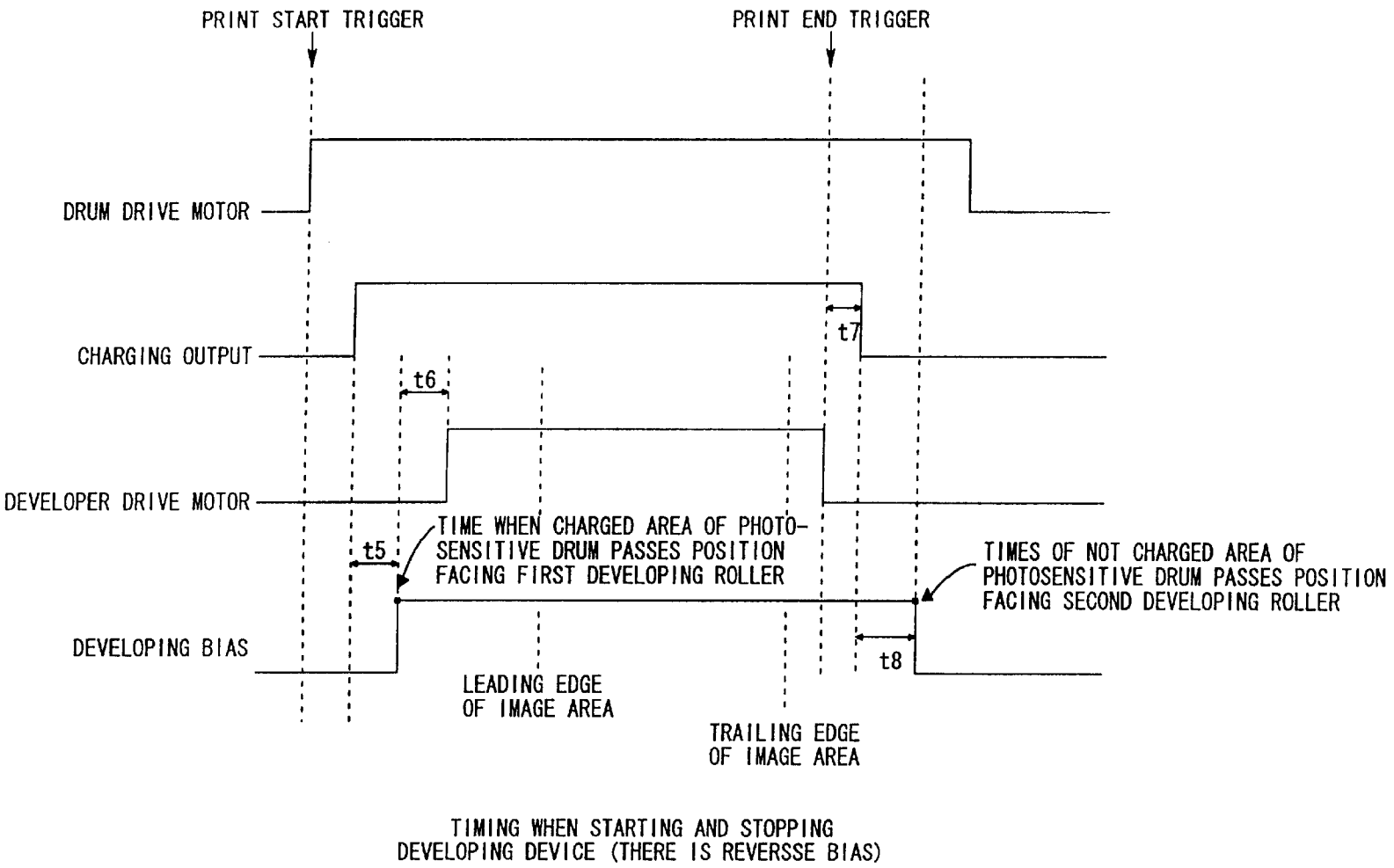
FIG. 10 is a timing chart for explaining the operation at the time of start and stop of the developing device of the present invention.

FIG. 10 is a timing charge for explaining the operation timing when driving and stopping the developing device using the bias controller 19 without equipping a reverse bias voltage transformer.

First, the operation when starting the developing device will be described. That is, as shown in FIG. 10, when starting the developing operation, the main controller 11 drives the drum drive motor 14 which rotates the photosensitive drum 9. Then, in order to charge the surface of the photosensitive drum 9 to a predetermined potential, the main controller 11 turns on the charging voltage output to the main charger 7 by the charging voltage output 18. On the lapse of a period of time (t5) from the turn-on of the charging voltage output till the charged area on the photosensitive drum 9 passes the position facing the first developing roller 1, the main controller 11 starts to feed regular bias voltage by the regular developing bias voltage transformer of the bias controller 19 so that the first and second developing rollers 1 and 2 have started up completely at regular developing bias voltage.

Further, on the lapse of a period of time (t6) from the switching to the regular bias voltage till the leading position of a first electrostatic latent image formed on the photosensitive drum 9 passes the position facing the first developing roller 1, the main controller 11 starts to rotate the developer drive motor 16 by the driver 17 so that the operating speeds of all units in the developing device have completely reached the steady state.

As described above, when starting the developing device without reverse bias voltage transformer equipped, with the developing bias voltage ON-OFF timing used as the timing of the all over developing, the developer drive motor is turned off when turning on the developing bias voltage. In other words, after the potential on the photosensitive drum and the potential of the first and the second developing rollers (all of plural developing rollers) become the steady state (that is, the photosensitive drum is VO, the developing roller is VB), the rotation of the developing rollers starts.

As a result, it becomes possible to prevent the carrier-adhering on a white background or the generation of all over developing when starting a cheap developing device without equipping a reverse bias voltage transformer.

Next, the operation when stopping the developing device will be described. As shown in FIG. 10, when stopping the developing device, the main controller 11 turns off the developer drive motor 16 by the driver 17 in order to stop the rotation of the first and second developing rollers. At this time, the first and second is developing rollers 1 and 2 are so controlled as to stop in the shortest time as could as possible. Then, on the lapse of a period of time (t7) from the turn-off of the developer drive motor 16 till the first and second developing rollers 1 and 2 stop completely, the main controller 11 turns off the charging voltage output to charge the photosensitive drum 9.

Further, on the lapse of a period of time (t8) from the turn-off of this charging voltage output till the not-charged area on the photosensitive drum 9 passes the position facing the second developing roller 2, the main controller 11 turns off the developing bias voltage being applied to the first and second developing rollers 1 and 2 by the bias controller 19. Thereafter, the main controller 11 turns off the drum drive motor 14 by the driver 15 in order to stop the rotation of the photosensitive drum 9 and completely stops the operation as the developing device.

As described above, to stop a developing device without a reverse bias voltage transformer equipped, the rotation of the developing rollers is first stopped and then, the charging voltage output and the developing bias voltage output are turned off in order.

Thus, when stopping a cheap developing device without a reverse bias voltage transformer equipped, the generation of a carrier-adhering on a white background or an all over developing can be prevented.

Now, a difference between the operation without a reverse bias voltage and that with a reverse bias voltage will be described.

A difference at the time of start-up is produced before the regular developing bias voltage is turned on. In this embodiment, there is no potential as the photosensitive drum is 0V and the developing rollers are also 0V. As this is apparent from the fact that the all over developing is not produced at a potential difference of several hundreds volt (generally, 300–400V) as shown in FIG. 9, the all over developing and the carrier-adherence on a white background are not at all generated as the developing rollers are not rotating. Further, when stopping the developing device, the all over developing and the carrier-adherence on a white background are not at all generated likewise the starting.

This was inspected by conducting a test for observing the surface of the photosensitive drum by executing the print operation actually without rotating the developing rollers with a difference between both potentials set as mentioned above. As a result of this test, it was revealed that no toner and carrier were adhered entirely on the photosensitive drum.

Further, in this test, plural roller developing devices were used for the evaluation and a two-component developing agent was used. The effect checking tests were conducted in 3 kinds of environments; low temperature/low humidity, normal temperature/normal humidity and high temperature/high humidity using early stage products and nearly life exhausting produces for photosensitive drums and developing agent (toner).

As a result of the above-mentioned embodiment, it has become possible to operate the developing device by outputting the developing bias voltage at the timing without causing the all over developing and the carrier-adhering on a white background using a cheap developing bias voltage transformer.

Further, this operation timing may be applicable in not only the ordinary printing but also, for instance, warm-up of copying machine, toner empty canceling, automatic toner adjustment, etc.

The operation in, for instance, the automatic toner adjustment will be described. In this case, because a developing bias voltage transformer without generating reverse bias voltage is used, the following means were taken.

Figure 11:
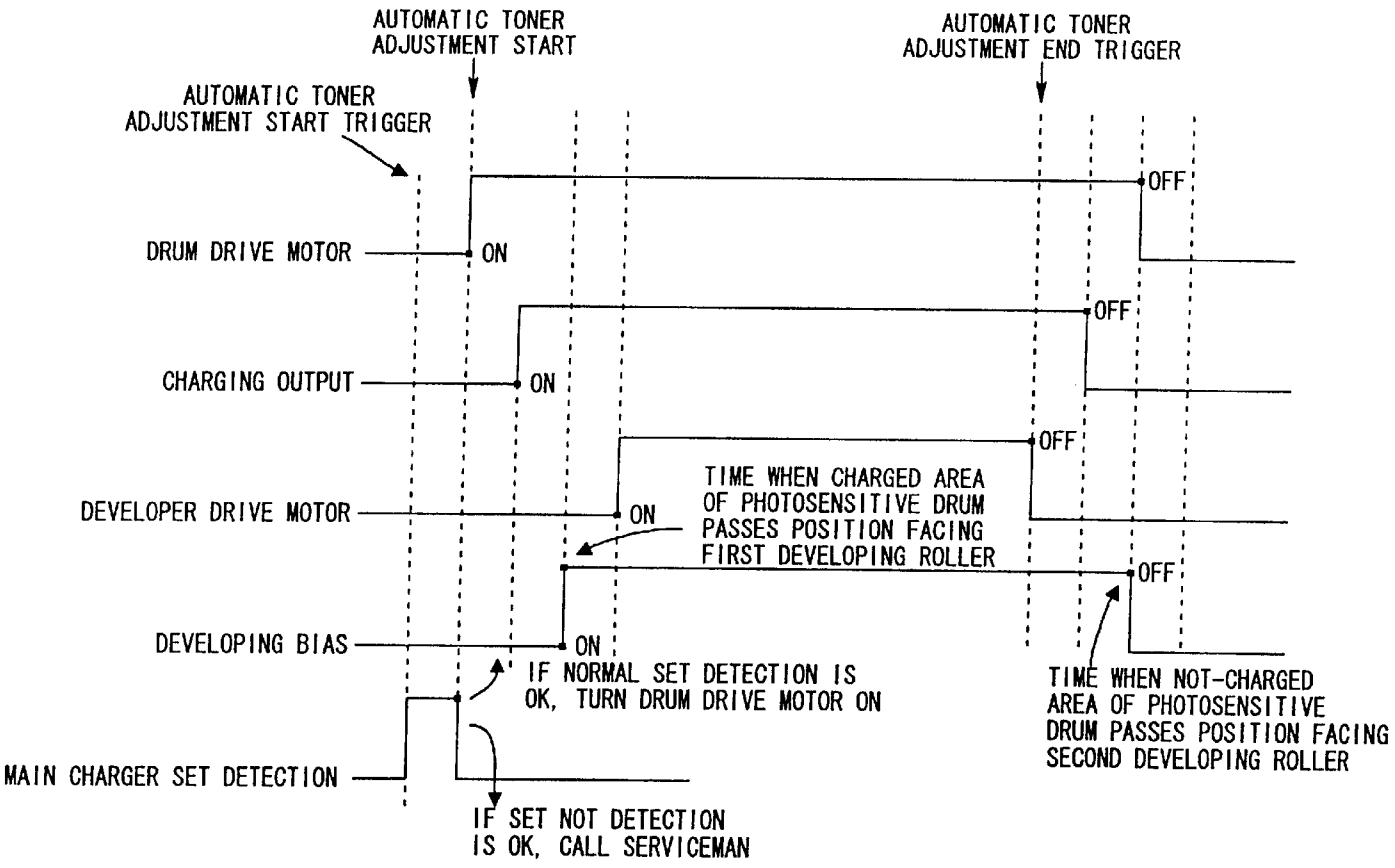
FIG. 11 is a timing chart for explaining the operation at the time of automatic toner regulation without reverse bias voltage of the developing device of the present invention.

FIG. 11 is a timing chart explaining the operation timing in the automatic toner adjustment. That is, when the automatic toner adjustment start trigger is detected, the main controller 11 detects the setting of the main charger 7 according to whether a wire cleaning mechanism is properly operating. When judged that the main charger 7 was not set in the normal state (forgotten to be set, set but not at a normal position, etc.) according to the result of this detection, the main controller 11 stops the operation of the unit completely because the proper setting of the main charger 7 was not detected. At this time, user is guided to call a serviceman who has the technical knowledge to perform the maintenance and inspection of the unit. This is because if the main charger 7 was not set properly, the charged potential of the photosensitive drum 9 becomes zero, the normal developing bias voltage is applied, a toner contained in a developing agent adheres to the photosensitive drum during the automatic toner adjustment, and the toner adjustment cannot be performed automatically.

Further, when judged that the main charger 7 was properly set, the main controller 11 starts the operation of the drum drive motor 14 to rotate the photosensitive drum 9, and turns on the charging voltage output to the main charger 7 by the charging voltage output 18 as shown in FIG. 11.

Further, when the charged area of the photosensitive drum 9 charged by the main charger 7 passes the position facing the first developing roller, the main controller 11 turns on the feed of regular developing bias voltage by the bias controller 19.

In this embodiment, the setting of the main charger is detected based on the judgement as to whether a wire cleaning mechanism (not shown) of the main charger is properly operating as mentioned above. In addition, as regards the charged potential during the automatic toner adjustment, the charging voltage is so controlled as to make the potential to a desirable level (that is, the white background contract potential becomes a center value) considering the life, temperature, cycle, etc. of the photosensitive drum. This operation timing is almost the same as that at the starting or stopping as shown in FIG. 10.

That is, in an image forming apparatus equipped with a plural roller developing device that operates at the timing of the present invention, the setting of the main charger is first detected and only when it is judged that the main charger was set at the regular position, the automatic toner adjustment is started. The charged potential of the photosensitive drum during the automatic toner adjustment is controlled to a definite value regardless of using frequency, temperature, etc. and furthermore, toner is automatically controlled so as to apply the regular developing bias voltage to the developing rollers.

Thus, it becomes possible to eliminate such defects as the all over developing and the carrier-adherence on a white background during the automatic toner adjustment in plural roller developing devices.

Further, the setting of the main charger is detected based on the judgement as to whether the wire cleaning mechanism of the main charger operates properly. When the main charger was not properly set, it is guided to call a serviceman for the maintenance and inspection of the developing device.

As a result, when the main charger was not properly set, it is possible to call a serviceman immediately and achieve the certain operation of the developing device.

As described above in detail, according to the present invention, it becomes possible to eliminate the all over developing and the carrier-adhering on a white background that are taken place when driving and stopping the plural roller developing device and make a life of it longer.

In addition, it is also possible to eliminate the all over developing and the carrier adherence on a white background that are taken place when driving and stopping plural roller developing devices equipped with a cheap developing bias voltage transfromer without generating reverse bias voltage.

What is claimed is:

1. A developing device comprising:

charging means for uniformly charging a surface of an image carrier during its movement;

exposure means for exposing to form an electrostatic latent image on the charged image carrier;

developing means provided facing the image carrier for supplying developing agent to the image carrier to develop the electrostatic latent image, the developing means including a first developing roller and a second developing roller arranged at the down stream side of the first developing roller in the moving direction of the image carrier;

bias applying means for applying a bias voltage to the first and second developing rollers;

control means for controlling the bias applying means to apply a reverse bias voltage of a reverse polarity opposite to the polarity of the charged image carrier to the first and second developing rollers until the charged area on the image carrier reaches the position facing the first developing roller, and then apply a regular bias voltage of the same polarity as the charged image carrier to the first developing roller when the leading edge of the charged area on the image carrier passes the position facing the first developing roller after the charging to the image carrier has started; and driving means for starting to drive the developing means before the leading edge of the electrostatic latent image formed on the image carrier passes the position facing the first developing roller after the control means controls the bias applying means to apply the regular bias voltage.

2. A developing device according to claim 1, wherein the bias applying means includes a single transformer from which the bias voltage is supplied to both of the first and second developing roller at same time.

3. A developing device according to claim 1, further comprising:

judging means for judging whether the charging means is properly operating; and notifying means for notifying that the developing device is not properly operated when the judging means judges that the charging means is not properly operating.

4. A developing device comprising:

charging means for uniformly charging a surface of an image carrier during its movement;

exposure means for exposing to form an electrostatic latent image on the charged image carrier;

developing means provided facing the image carrier for supplying developing agent to the image carrier to develop the electrostatic latent image, the developing means including a first developing roller and a second developing roller arranged at the down stream side of the first developing roller in the moving direction of the image carrier;

bias applying means for applying a reverse bias voltage of the reverse polarity opposite to the polarity of the charged image carrier to the first and second developing rollers;

first control means for stopping the charging of the image carrier by the charging means after stopping the drive of the first and second developing rollers;

second control means for controlling the bias applying means to apply reverse bias voltage to the first and second developing rollers so that the reverse bias voltage rises when the leading edge of the not-charged area on the image carrier passes the position facing the second developing roller after stopping the charging of the image carrier; and third control means for stopping application of bias voltage to the first and second developing rollers and stopping drive of the image carrier after applying the reverse bias voltage.

5. A developing device according to claim 4, wherein the bias applying means includes a single transformer from which the bias voltage is supplied to both of the first and second developing roller at same time.

6. A developing device according to claim 4, further comprising:

judging means for judging whether the charging means is properly operating; and notifying means for notifying that the developing device is not properly operated when the judging means judges that the charging means is not properly operating.

7. A developing device comprising:

charging means for uniformly charging the surface of an image carrier during its movement;

exposure means for exposing to form an electrostatic latent image on the charged image carrier;

developing means provided facing the image carrier for supplying developing agent to the image carrier to develop the electrostatic latent image, the developing means including a first developing roller and a second developing roller arranged at the down stream side of the first developing roller in the moving direction of the image carrier;

bias applying means for applying a regular bias voltage of the same polarity as the charged image carrier to the first and second developing rollers;

first control means for starting the charging of the image carrier by the charging means after starting the movement of the image carrier;

second control means for controlling the bias applying means to apply the regular bias voltage on the lapse of a prescribed time from the starting the charging of the image carrier till charged area on the image carrier passes the position facing the first developing roller;

third control means for starting the drive of the first and second developing rollers;

fourth control means for stopping the drive of the first and second developing rollers;

fifth control means for stopping the charging of the image carrier by the charging means after stopping the drive of the first and second developing rollers;

sixth control means for stopping the application of the regular bias voltage by the bias applying means when the leading edge of the not-charged area on the image carrier passes the position facing the second developing roller after stopping the charging of the image carrier; and seventh control means for stopping the drive of the image carrier after stopping the application of the regular bias voltage by the sixth control means.

8. A developing device according to claim 7, wherein the bias applying means includes a single transfromer from which the bias voltage is supplied to both of the first and second developing roller at same time.

9. A developing device according to claim 7, further comprising:

judging means for judging whether the charging means is properly operating; and notifying means for notifying that the developing device is not properly operated when the judging means judges that the charging means is not properly operating.

10. A developing device comprising:

a charger configured to charge a surface of an image carrier uniformly during its movement;

an exposure unit configured to expose an optical image to form an electrostatic latent image on the charged image carrier;

a developing unit provided facing the image carrier to supply developing agent to the image carrier to develop the electrostatic latent image, the developing unit including a first developing roller and a second developing roller arranged at the down stream side of the first developing roller in the moving direction of the image carrier;

a bias voltage transformer configured to apply a bias voltage to the first and second developing rollers;

a controller configured to control the bias voltage transformer to apply a reverse bias voltage of a reverse polarity opposite to the polarity of the charged image carrier to the first and second developing rollers until the charged area on the image carrier reaches the position facing the first developing roller, and then apply a regular bias voltage of the same polarity as the charged image carrier to the first developing roller when the leading edge of the charged area on the image carrier passes the position facing the first developing roller after the charging to the image carrier has started; and a driver configured to start to drive the developing unit before the leading edge of the electrostatic latent image formed on the image carrier passes the position facing the first developing roller after the controller controls the bias voltage transformer to apply the regular bias voltage.

11. A developing device comprising:

charger configured to charge a surface of an image carrier uniformly during its movement;

an exposure unit configured to expose an optical image to form an electrostatic latent image on the charged image carrier;

a developing unit provided facing the image carrier to supply developing agent to the image carrier to develop the electrostatic latent image, the developing unit including a first developing roller and a second developing roller arranged at the down stream side of the first developing roller in the moving direction of the image carrier;

a bias voltage transformer to apply a reverse bias voltage of the reverse polarity opposite to the polarity of the charged image carrier to the first and second developing rollers;

a first controller configured to stop the charging of the image carrier by the charger after stopping the drive of the first and second developing rollers;

a second controller configured to control the bias voltage transformer to apply the reverse bias voltage to the first and second developing rollers so that the reverse bias voltage rises when the leading edge of the not-charged area on the image carrier passes the position facing the second developing roller after stopping the charging of the image carrier; and a third controller configured to stop application of bias voltage to the first and second developing rollers and stop drive of the image carrier after applying the reverse bias voltage.

12. A developing device comprising:

a charger configured to charge a surface of an image carrier uniformly during its movement;

an exposure unit configured to expose an optical image to form an electrostatic latent image on the charged image carrier;

a developing unit provided facing the image carrier to supply developing agent to the image carrier to develop the electrostatic latent image, the developing unit including a first developing roller and a second developing roller arranged at the down stream side of the first developing roller in the moving direction of the image carrier;

a bias voltage transformer configured to apply a regular bias voltage of the same polarity as the charged image carrier to the first and second developing rollers;

a first controller configured to start the charging of the image carrier by the charger after starting the movement of the image carrier;

a second controller configured to control the bias voltage transformer to apply the regular bias voltage on the lapse of a prescribed time from the starting the charging of the image carrier till charged area on the image carrier passes the position facing the first developing roller;

a third controller configured to start the drive of the first and second developing rollers;

a fourth controller configured to stop the drive of the first and second developing rollers;

a fifth controller configured to stop the charging of the image carrier by the charger after stopping the drive of the first and second developing rollers;

a sixth controller configured to stop the application of the regular bias voltage by the bias voltage transformer when the leading edge of the not-charged area on the image carrier passes the position facing the second developing roller after stopping the charging of the image carrier; and a seventh controller configured to stop the drive of the image carrier after stopping the application of the regular bias voltage by the sixth controller.

13. A developing method of an image forming device including developing means provided facing an image carrier for supplying developing agent to the image carrier to develop an electrostatic latent image, the developing means including a first developing roller and a second developing roller arranged at the down stream side of the first developing roller in the moving direction of the image carrier, the method comprising the steps of:

charging a surface of the image carrier during its movement;

exposing to form the electrostatic latent image on the charged image carrier;

applying a reverse bias voltage of a reverse polarity opposite to the polarity of the charged image carrier to the first and second developing rollers until the charged area on the image carrier reaches the position facing the first developing roller;

applying a regular bias voltage of the same polarity as the charged image carrier to the first developing roller when the leading edge of the charged area on the image carrier passes the position facing the first developing roller after the charging to the image carrier has started; and starting to drive the developing means for the leading edge of the electrostatic latent image formed on the image carrier passes the position facing the first developing roller after applying the regular bias voltage.

14. A developing method in an image forming device including developing means provided facing an image carrier for supplying developing agent to the image carrier to develop an electrostatic latent image, the developing means including a first developing roller and a second developing roller arranged at the down stream side of the first developing roller in the moving direction of the image carrier, the method comprising the steps of:

charging a surface of the image carrier during its movement;

exposing to form the electrostatic latent image on the charged image carrier;

applying a reverse bias voltage of the reverse polarity opposite to the polarity of the charged image carrier to the first and second developing rollers;

stopping the charging of the image carrier after stopping the drive of the first and second developing rollers;

applying a reverse bias voltage to the first and second developing rollers so that the reverse bias voltage rises when the leading edge of the not-charged area on the image carrier passes the position facing the second developing roller after stopping the charging of the image carrier; and stopping application of bias voltage to the first and second developing rollers and stopping drive of the image carrier after applying the reverse bias voltage.

15. A developing method in an image forming device including developing means provided facing an image carrier for supplying developing agent to the image carrier to develop an electrostatic latent image, the developing means including a first developing roller and a second developing roller arranged at the down stream side of the first developing roller in the moving direction of the image carrier, the method comprising the steps of:

charging a surface of the image carrier during its movement;

expositing to form the electrostatic latent image on the charged image carrier;

applying a regular bias voltage of the same polarity as the charged image carrier to the first and second developing rollers;

starting the charging of the image carrier after starting the movement of the image carrier;

applying the regular bias voltage on the lapse of a prescribed time from the starting the charging of the image carrier till charged area on the image carrier passes the position facing the first developing roller;

starting the drive of the first and second developing rollers;

stopping the drive of the first and second developing rollers;

stopping the charging of the image carrier after stopping the drive of the first and second developing rollers;

stopping the application of the regular bias voltage when the leading edge of the not-charged area on the image carrier passes the position facing the second developing roller after stopping the charging of the image carrier; and stopping the drive of the image carrier after stopping the application of the regular bias voltage.

* * * * *